United States Patent [19]

Balestra

[11] Patent Number: 4,705,738

[45] Date of Patent: Nov. 10, 1987

[54] SILVER HALIDE PHOTOGRAPHIC MATERIAL FOR TANNING DEVELOPMENT AND PROCESS OF PRODUCING A RELIEF IMAGE

[75] Inventor: Luciano Balestra, Savona, Italy

[73] Assignee: Minnesota Mining and Manufacturing Company, St. Paul, Minn.

[21] Appl. No.: 838,368

[22] Filed: Mar. 11, 1986

[30] Foreign Application Priority Data

Mar. 18, 1985 [IT] Italy ..... 19945 A/85

[51] Int. Cl.[4] ..... G03C 1/06; G03C 7/10

[52] U.S. Cl. ..... 430/264; 430/405; 430/566

[58] Field of Search ..... 430/264, 405, 566

[56] References Cited

U.S. PATENT DOCUMENTS

| | | | |
|---|---|---|---|
| 3,364,024 | 6/1963 | Yackel et al. | 96/29 |
| 3,440,049 | 4/1969 | Moede | 96/66 |
| 4,369,245 | 1/1983 | Beruto et al. | 430/264 |
| 4,448,878 | 5/1984 | Yamamuro et al. | 430/614 |
| 4,456,676 | 6/1984 | Ciskowski | 430/264 |
| 4,504,572 | 3/1985 | Beruto et al. | 430/264 |
| 4,544,620 | 10/1985 | Macioch | 430/264 |

FOREIGN PATENT DOCUMENTS 1248213 9/1971 United Kingdom .

*Primary Examiner*—Won H. Louie

*Attorney, Agent, or Firm*—Donald M. Sell; James A. Smith; Mark A. Litman

[57] ABSTRACT

In a silver halide photographic material for tanning development, comprising a support base coated with a substantially unhardened hydrophilic binder layer including a light-sensitive silver halide emulsion reactively associated with a tanning developer and a dispersion of colloidal silver, the tendency of the hydrophilic binder to become water-insoluble during storage can be prevented by adjusting the pAg of the colloidal silver dispersion to values in the range from 6.5 to 9.5 with a 1-phenyl-5-mercaptotetrazole compound before coating.

12 Claims, No Drawings

SILVER HALIDE PHOTOGRAPHIC MATERIAL FOR TANNING DEVELOPMENT AND PROCESS OF PRODUCING A RELIEF IMAGE

FIELD OF THE INVENTION

The present invention relates to silver halide photographic materials for tanning development. In particular, the present invention relates to silver halide photographic material for tanning development including a colloidal silver dispersion as a pigment.

STATE OF THE ART

Methods of photographic reproduction are known which comprise the steps of (1) image-wise exposing a photographic material (comprising a support containing coated thereon a layer including a light sensitive silver halide emulsion in a hardenable binder), (2) developing the latent silver image thus formed in said photographic material by treating the material with an aqueous alkali solution in the presence of silver halide developing agent whose oxidation product, formed upon development, is capable of hardening the binder and thereby hardening the binder in the exposed areas, and (3) removing the unexposed unhardened areas to form a relief image either by washing off these areas with warm water, or totally or partially transferring them onto an image-receiving material.

This method of photographic reproduction is generally known as tanning development and the silver halide developing agents for use therein are known as tanning developers. Such tanning development is disclosed in U.S. Pat. Nos. 2,596,756; 3,364,024; 3,440,049 and 4,233,392; and British Pat. No. 1,294,355.

It is also known to add photographically inert water-insoluble colored pigments to the light-sensitive silver halide emulsion layer or to an associated light-insensitive layer comprising a hardenable binder. The layer containing the pigment is likewise image-wise hardened during the tanning development and contributes to the formation of the image, since the optical density of the image is contributed to both by the silver and the pigment. Among the various pigments which have been suggested for use in the silver halide photographic element for tanning development, colloidal silver appears to be preferable particularly when said silver halide photographic element is to be used in photo-lithographic industry for making dot or line images. In this case, it is possible to adjust the hue of a lithographic print by submitting the dot and line image to a process called "dot-etching", which consists of treatment with a solution of mild oxidizing agents to partially dissolve the metallic silver of dot and line images.

However, silver halide photographic elements for tanning development having colloidal silver dispersed therein as a pigment have a considerable disadvantage. An undesirable hardening of the gelatin over time occurs due to a mutual effect or action between colloidal silver and gelatin. This undesirable hardening leads to the result that, after exposure and development, it is no longer possible to have a sufficient differentiation between the hardened and non-hardened areas of the image.

Therefore, it is highly desirable to provide light-sensitive colloidal silver containing materials for tanning development which have better stability against hardening during time.

SUMMARY OF THE INVENTION

It has been found, according to the present invention, that the tendency of the hydrophilic binder to become water-insoluble during storage of a silver halide photographic material for tanning development (said element comprising a support base coated with a substantially unhardened hydrophilic binder layer including a light-sensitive silver halide emulsion associated with a tanning developer and a dispersion of colloidal silver) can be prevented by maintaining the pAg (pAg being $-\log[Ag^+]$ wherein the concentration of silver ion is expressed in gram-ions per liter) of the colloidal silver dispersion at values between 6.5 and 9.5 with a 1-phenyl-5-mercaptotetrazole compound before coating.

DETAILED DESCRIPTION OF THE INVENTION

The present invention relates to a process for producing a relief image on a silver halide photographic element for tanning development, which process comprises image-wise exposing said element, developing the exposed element in an alkali-activating bath and thereafter washing off the unhardened areas of the image with water, said photographic element comprising a support base coated with a substantially unhardened hydrophilic binder layer comprising a light-sensitive silver halide emulsion reactively associated with a tanning developer and a colloidal silver dispersion, characterized in that the pAg of the colloidal silver dispersion has been corrected before coating to values in the range from 6.5 to 9.5 with a 1-phenyl-5-mercaptotetrazole compound.

According to another aspect, the invention relates to a silver halide photographic element for tanning development comprising a support base having coated thereon at least one substantially unhardened photographic binder layer comprising a light-sensitive silver halide emulsion reactively associated with a tanning developer and a colloidal silver dispersion, characterized in that the colloidal silver dispersion includes a 1-phenyl-5-mercaptotetrazole compound in an amount which maintains the pAg at a range of from 6.5 to 9.5.

In a further aspect, the present invention relates to a silver halide photographic element for tanning development comprising a support base having coated thereon at least one substantially unhardened photographic binder layer comprising a light-sensitive silver halide emulsion reactively associated with a tanning developer and a colloidal silver dispersion, characterized in that the collodial silver dispersion includes a 1-phenyl-5-mercaptotetrazole compound in an amount comprised between 0.2 and 1 gram per mole of colloidal silver.

In particular, the photographic element comprises two superimposed substantially unhardened hydrophilic binder layers, one of which includes the light-sensitive silver halide emulsion and the other the dispersion of the colloidal silver. According to a particular construction, the substantially unhardened hydrophilic binder layer including the light-sensitive silver halide emulsion is coated on the substantially unhardened hydrophilic binder layer including the dispersion of the colloidal silver. According to another particular construction, the substantially unhardened hydrophilic binder layer including the dispersed colloidal silver is coated on the substantially unhardened hydrophilic binder layer including the light-sensitive silver halide emulsion. When the silver halide including layer is coated next to the support with the dispersed colloidal silver including layer coated above it, the support should be transparent so that the exposure can be made through the support. When the dispersed colloidal silver including layer is coated next to the support with the silver halide layer above it, a normal exposure, i.e. exposure with the emulsion side towards the light source, should be effected and an opaque support used.

The photographic element further comprises a single substantially unhardened hydrophilic binder layer including both the light-sensitive silver halide emulsion and the dispersed colloidal silver. The silver halide photographic element for tanning development can additionally comprise a substantially unhardened hydrophilic binder layer coated on the support base between the support base and the substantially unhardened hydrophilic binder layer including the silver halide emulsion and/or the colloidal silver dispersion.

The preferred hydrophilic binder for the light-sensitive silver halide and/or the dispersed colloidal silver containing layer is gelatin. However, other hardenable binders such as polyvinyl alcohol or a modified polyacrylamide may be used.

By the term "substantially unhardened hydrophilic binder", as used herein, a binder is meant which is capable of being melted or dissolved in water at a temperature between 20° and 70° C. In case of gelatin, this expression more specifically means not hardened gelatin or gelatin which is not harder than gelatin containing 0.7 grams of dry formaldehyde per 454 grams of gelatin when freshly coated or 0.3 grams of dry formaldehyde per 454 grams of gelatin when aged for example for 3 to 6 months.

The silver halide emulsions can be any of the well-known silver halide emulsions including silver chloride, silver bromide, silver chloro-iodide, silver chloro-bromide, silver chloro-bromo-iodide, silver bromo-iodide, etc.

The preferred developing agent is hydroquinone, but other tanning developing agents, such as pyrogallol or catechol may be used. In an alternative embodiment, a combination of developing agents, whose oxidation products exert a tanning effect, can be used. In another alternative embodiment, a combination of a tanning developer and a developing agent whose oxidation products do not exert a tanning effect is used, in particular a combination of a tanning developer and a 3-pyrazolidone compound, as described in U.S. patent application Ser. No. 520,500 filed Aug. 4, 1983 which is useful for obtaining relief images upon short exposure to high intensity light of a photographic element for tanning development including a high-sensitivity emulsion coated with gelatin at a low silver coverage and a low silver-gelatin ratio, said patent application being incorporated herein by reference.

The developing agent is preferably present in the unhardened binder layer including the light-sensitive silver halide emulsion and/or the dispersed colloidal silver. Alternatively, but less preferably, the developing agent may be present in the alkali-activating bath.

The coverage of the silver halide emulsion and the silver-gelatin ratio can be varied depending upon the use intended. To improve the quality of the image, specific useful coverages of silver halide and silver halide-gelatin ratios are, those disclosed in U.S. Pat. Nos. 4,369,245, filed by the Applicant, which is incorporated herein by reference, and in particular silver coverages lower than 0.6 grams per square meter, preferably lower than 0.4 and more preferably lower than 0.2 grams per square meter and silver-gelatin weight ratios lower than 0.4, preferably lower than 0.2 and more preferably in the range from 0.05 to 0.15.

A useful layer in the photographic element for tanning development of the present invention is an unhardened binder outermost protective layer coated on said unhardened binder layer including the light-sensitive silver halide emulsion and/or the dispersed colloidal silver pigment, particularly an unhardened outermost gelatin layer including non-diffusing hydroquinones, as described in U.S. Pat. No. 4,504,572 incorporated herein by reference. Said non-diffusing hydroquinones are preferably hydroquinones substituted with aliphatic chains containing a total of at least twelve carbon atoms and, more preferably, are dispersed in the binder layer dissolved in a high-boiling organic solvent, such as described for example in U.S. Pat. Nos. 2,322,027; 2,801,170; 2,801,171 and 2,991,177.

To produce the relief image, the photographic element is image-wise exposed, then developed in an activating bath in the presence of the tanning developer and subsequently image-wise washed off. The activating bath contains an alkalizing agent, such as sodium or potassium carbonate. Particularly useful is an activating bath including significant quantities of a water-immiscible organic solvent, chosen from the class including dihydric alcohols, polyhydric alcohols and polyoxyethylene glycols or mixtures thereof, and more particularly useful is an activating bath including significant quantities of sodium sulfate in order to improve the quality and repeatability of the obtained photographic results, especially when processing is performed with automatic processors with transporting rollers in contact with air. It is preferred that the development is stopped after a length of time by immersing the material into an acid bath, e.g. an aqueous acetic acid bath, or simply into water.

During the development stage, the exposed silver halide is reduced to silver and the developing agent is oxidized. Its oxidation products harden the hydrophilie binder which is associated with the developed silver and the colloidal silver pigment or harden the binder which is associated with the developed silver and also diffuses into the binder layer associated with the colloidal silver pigment, hardening the hydrophilic binder in this layer.

It is known that the oxidized developer product diffuses directly from one layer into the other in image-wise fashion and does not diffuse laterally to any substantial extent. Thus the colloidal silver pigment containing layer is hardened by the diffusing developer oxidation product in exactly the same areas as in the silver halide layer.

After development and hardening, the portions of the binder layers including both unhardened silver halide emulsion and the colloidal silver pigment or of the binder layers including the silver halide emulsion and the colloidal silver pigment, are removed. This removal may be accomplished by washing the material in water.

A relief image of silver is therefore produced from the silver halide emulsion in hardened binder whose optical density is reinforced by a relief image of silver derived from the colloidal silver dispersed in hardened binder, which exactly corresponds to the first silver image.

The colloidal silver dispersions to be used in the method of the present invention can be prepared with various methods known in the art. According to these methods, preferably a water-soluble silver salt, such as silver nitrate, in an aqueous solution of gelatin is reduced with an inorganic reducing agent, such as hydrazine and alkali borohydride or with an organic reducing agent, such as hydroquinone, tolylhydroquinone, catechol, monomethylaminophenol, 1-phenyl-3-pyrazolidone, paraphenylendiamine, aminoborane and ascorbic acid. Preferably, the soluble silver salt is reduced in the presence of an alkali sulfite and a water soluble alkali earth metal salt, such as a calcium (GB Pat. No. 721,638), strontium (BE Pat. No. 630,385), or magnesium (GB Pat. No. 1,018,837) salt. Said dispersions of colloidal silver are neutral or slightly bluish black and are generally used for antihalation layers on the backs of multilayer color films for the purpose of preventing halation caused by the reflection of rays of light from the surface of the film support and protecting the film from fogging caused by light incident on the back of the film. In order to improve the stability of the finished dispersions, organic thiol compounds can be added to the black dispersions of colloidal silver, preferably prior to the washing procedure, as for example described in GB Pat. No. 1,248,213. Suitable compounds are 2-mercaptoimidazole, 2-mercaptobenzimidazole, 2-mercaptobenzoxazole, 5-carboethoxy-2-mercapto-4-methylthiazole, 2-mercaptothiazole, 3-mercapto-1,2,4-triazole, 2-mercapto-5-methylthio-1,3,4-oxadiazole and 1-phenyl-5-mercaptotetrazole. The effect of the addition of organic thiol compounds to the black despersion of colloidal silver is the improvement of their tone and the stabilization of the dispersions which turn reddish on storage or decrease their optical density. According to the present invention, it has been found that the addition of a 1-phenyl-5-mercaptotetrazole compound in an amount to have the pAg in the range from 6.5 to 9.5, is specific for obtaining a silver dispersion which does not cause hardening of gelatin after a long period of storage in a photographic element, comprising a binder which is substantially unhardened and is intended to be used in a photographic element for tanning development.

The term "1-phenyl-5-mercaptotetrazole compound", as used herein, is intended to refer to any non substituted or substituted 1-phenyl-5-mercaptotetrazole nucleus, whose substituents on the phenyl nucleus are chosen in size and nature as not to negatively affect the stability of the colloidal silver dispersions. With respect to their size, such substituents are preferred to have from 1 to 10 carbon atoms. With respect to their nature, such substituents may be substituents known in the art not to have deleterious photographic effects, such as a hydroxy group, a halogen atom, an alkyl group, an alkoxy group, an alkylcarbonyl group, a cyano group, a sulfonyl group, a phenyl group, etc.

Such effect (i.e. avoiding the premature hardening of the binder before tanning development) can be obtained by adding the silver colloidal dispersion with other mercaptotetrazole compounds, such as 1-n-dodecyl-5-mercaptotetrazole, 1-n-tetradecyl-5-mercaptotetrazole, 1-n-octadecyl-5-mercaptotetrazole, but these compounds have the drawback of lowering the optical density of the colloidal silver dispersion. Other thiol compounds different from 1-phenyl-5-mercaptotetrazole compounds appear not to avoid the premature hardening of the gelatin layer containing the colloidal silver dispersion. According to the present invention, the pAg of the colloidal silver dispersion is in the range from 6.5 to 9.5 because of the addition of the 1-phenyl-5-mercaptotetrazole compound. The pH-value of the silver colloidal dispersion is apparently not so important as its pAg value, but we can say that it can usefully range from 4 to 5.5. Under the experimental conditions in which the Applicant has operated, the preferred amount of 1-phenyl-5-mercaptotetrazole compound necessary to correct the pAg of the silver colloidal dispersion in the range from 6.5 to 9.5 is in the range from 0.29 to 0.60 grams per mole of silver. Of course, said amount may vary depending upon the composition of the silver dispersion. The skilled in the art may easily find the amount of 1-phenyl-5-mercaptotetrazole compound necessary to correct the pAg of the silver halide dispersion into values within the range of the present invention. It is however understood that quantity values useful to the purposes of the present invention will range from 0.2 to 1 grams per mole of silver. The problem of avoiding the hardening of the gelatin after a period of storage, caused by colloidal silver dispersions, has been dealt with in photography by using a gelatin derivative (obtained by treating the amino groups of the gelatin with phthalic anhydride, etc.), such as described in the JA patent application Ser. No. 51-89722, but of course said treated gelatin cannot be employed in a photographic element for tanning development in which the gelatin has to keep the amino groups free for tanning during development.

The following is intended to illustrate a method of manufacturing a dispersion of colloidal silver to be used in the process and compositions of the invention.

MANUFACTURE OF A COLLOIDAL SILVER DISPERSION 100 ml of water comprising 11 grams of inert ossein gelatin, 0.23 grams of sodium citrate and 2.3 grams of a 1% methanol solution of 1-phenyl-5-mercaptotetrazole at the temperature of 35°–50° C., under stirring, were added with 1.35 ml of a 85% water solution of hydrazine hydrate diluted in 37 ml of water. After 1 minute, 6.1 grams of silver nitrate dissolved in 55 ml of water were added at the same temperature. After 20 minutes, 3 grams of a 30% water solution of sodium hydrate were added until a pH of 6.2–6.4 was obtained The dispersion showed to have a pAg of 5.2 to 5.5.

The resulting dispersion of colloidal silver in gelatin was then chilled, shredded into pieces, washed repeatedly with cold water until inorganic ions were hardly detectable.

The invention will be now illustrated by the following examples.

Three photographic elements (1A, 1B and 1C) for tanning development were prepared as follows.

The first element (1A) was prepared by coating onto a resin coated paper base the following layers in the indicated order:

(a) an unhardened light insensitive layer of a thickness of 1.4 micron containing gelatin at a coverage of 1.25 g/m$^2$, a dispersion of black colloidal silver, prepared as described above, at a silver coverage of 0.15 g/m$^2$ and phenidone at a coverage of $2.5\times10^{-2}$ g/m$^2$, said dispersion having a pH of 4.5 and a pAg corrected from 5.19 to 7 with 1-phenyl-5-mercaptotetrazole;

(b) an unhardened light-sensitive layer, having a thickness of 2.4 micron, containing a silver chloro iodobromide emulsion (comprising 88% mole silver bromide, 7% mole silver iodide and 5% mole silver chloride, and having particles with an average size of 0.35 micron) coated at a silver coverage of 0.55 g/m$^2$, gelatin as to obtain a silver-gelatin ratio of 0.3 and hydroquinone as to obtain a gelatin-hydroquinone ratio of 5.7;

(c) an unhardened protective layer having a thickness of 2.4 micron, containing gelatin at a coverage of 1.3 $g/m^2$, a dispersion of 2.5-diisoctylhydroquinone (DIOH) in tricresylphosphate at a DIOH coverage of 0.72 $g/m^2$.

The second element (1B) was prepared by coating onto a resin coated paper hase the following layers in the indicated order:

(a) the same light-insensitive layer of Film A;

(b) a light-insensitive layer similar to that of Film 1A at a silver coverage of 0.48 $g/m^2$ and a gelatin coverage of 1.61 $g/m^2$;

(c) a protective layer similar to that of Film 1A at a DIOH coverage of 0.18 $g/m^2$.

The third element (1C) was prepared by coating onto a resin coated paper base the following layers in the indicated order:

(a) the same light-insensitive layer of Film 1A;

(b) a light-sensitive layer similar to that of Film 1A at a silver coverage of 0.4 $g/m^2$, a gelatin coverage of 1.61 $g/m^2$ and hydroquinone as to obtain a gelatin-hydroquinone ratio of 8.3.

Samples of the elements 1A, 1B and 1C, both just coated and stored for 15 hours at 50° C. after coating, were exposed in a 7700 Compugraphic Phototypesetter and processed in an automatic processor at a speed of 60 cm/min, in the following processing baths:

a first bath comprising a water solution of $Na_2CO_3$ at a 2% concentration and $Na_2SO_4$ at a 13% concentration, having a pH of 12.4 and a temperature of 34° C.;

a second bath comprising tap water at 47° C.; and a third bath comprising tap water at room temperature.

All the sample above gave good results in terms of image and sharpness with letters having densities of 1.58–1.60, sharp edges and without frazings.

Three other photographic elements (1D, 1E and 1F) for tanning development were prepared in a similar way to the preceeding ones (viz. 1D to 1A, 1E to 1B and 1F to 1C, respectively), but containing a dispersion of black colloidal silver coated at a silver coverage of 0.15 $g/m^2$, said dispersion having a pH of 5 and a pAg of 5.2.

Samples of the elements 1D, 1E and 1F, both just coated and stored for 15 hours at 50° C. after coating, were exposed and processed as said hereinbefore. All samples showed no differentiation between the exposed and unexposed areas of the image, but only a continuous black surface without washing off the unexposed areas.

EXAMPLE 2

Two photographic elements (2A and 2B) for tanning development were prepared as follows.

The first element (2A) was prepared by coating onto a subbed polyethylene terephthalate support base the following layers in the indicated order:

(a) an unhardened light-sensitive layer comprising a chemically sensitized silver chloro-bromide emulsion (comprising 66% mole silver bromide and 34% mole silver chloride and having particles with an average size of 0.3 micron, a pH of 5.2 and a pAg of 6.8), coated at the silver coverage of 0.35 $g/m^2$, at a gelatin coverage of 3.9 $g/m^2$, hydroquinone as to obtain a gelatin-hydroquinone ratio of 5.9, phenidone at a coverage of 0.66 $g/m^2$;

(b) an unhardened light-insensitive layer comprising gelatin at a coverage of 2.34 $g/m^2$, a dispersion of black colloidal silver coated at a silver coverage of 0.85 $g/m^2$, said dispersion having a pH of 4.5 and a pAg corrected from 5.15 to 7 with 1-phenyl-5-mercaptotetrazole;

(c) an unhardened protective layer comprising gelatin at a coverage of 0.57 $g/m^2$ and a dispersion of 2,5-diisoctylhydroquinone (DIOH) in tricresylphosphate at a DIOH coverage of 0.135 $g/m^2$.

The second element (2B) was prepared in a similar way to element 2A, but containing a black colloidal silver coated at a silver coverage of 0.85 $g/m^2$, said dispersion having a pH of 5 and a pAg of 5.15.

Samples of the two films were stored at 50° C. for 15 hours, then exposed by contact with a By-Chrome Percentage-Calibrated Tint sold by By-Chrome Co., comprising gray scales of black dots with dot percentages from 5 to 90 at different resolving powers (65, 85, 100, 110, 120, 130, 150 lines/mm).

Samples of the exposed films were processed as described in Example 1.

With Film 2A, dots at 90% dot percentage and resolving power of 150 lines/mm were reproduced perfectly.

With Film 2B, even dots at 5% dot percentage and 65 lines/mm remained closed.

I claim:

1. A process of producing a relief image on a silver halide photographic element for tanning development, which process comprises image-wise exposing said element, developing the exposed element in an alkali activating bath, and thereafter washing off the unhardened areas of the image with water, said photographic element comprising a support base coated with a substantially unhardened gelatin hydrophilic binder layer comprising a light-sensitive silver halide emulsion reactively associated with a tanning developer and a dispersion of collodial silver, characterized in that the pAg of the colloidal silver dispersion has been corrected before coating after washing to a value on the range from 6.5 to 9.5 with a 1-phenyl-5-mercaptotetrazole compound in an amount comprised between 0.2 and 1 gram per mole of collodial silver sufficient to prevent an undesirable hardening of the unhardened gelatin hydrophilic binder over time due to a mutual effect or action between the colloidal silver and the unhardened gelatin hydrophilic binder.

2. A photographic element for tanning development which comprises a support base having coated thereon at least one substantially unhardened gelatin hydrophilic binder layer comprising a light-sensitive silver halide emulsion reactively associated with a tanning developer and a dispersion of collodial silver, characterized in that the dispersed collodial silver includes a 1-phenyl-5-mercaptotetrazole compound in an amount to have a pAg comprised in the range from 6.5 to 9.5 comprised between 0.2 and 1 gram per mole of collodial silver sufficient to prevent an undesirable hardening of the unhardened gelatin hydrophilic binder over time due to a mutual effect or action between the colloidal silver and the unhardened gelatin hydrophilic binder.

3. The photographic element as claimed in claim 2, which comprises a support base having coated thereon two superimposed substantially unhardened gelatin hydrophilic binder layers, one of which includes the light-sensitive silver halide emulsion and the other the dispersion of colloidal silver.

4. The photographic element as claimed in claim 3, wherein the unhardened gelatin hydrophilic binder layer including the light-sensitive silver halide emulsion is coated onto the unhardened hydrophilic binder layer including the dispersion of colloidal silver.

5. The photographic element as claimed in claim 3, wherein the substantially unhardened gelatin hydrophilic binder layer including the colloidal silver dispersion is coated onto the substantially unhardened binder layer including the light-sensitive silver halide emulsion.

6. The photographic element as claimed in claim 2, wherein a single substantialy unhardened gelatin hydrophilic binder layer includes the light-sensitive silver halide emulsion and the collodial silver dispersion.

7. The photographic element as claimed in claim 2, wherein the tanning developer is included in the substantially unhardened gelatin hydrophilic binder layer including the light-sensitive silver halide emulsion and/or the colloidal silver dispersion.

8. The photographic element as claimed in claim 2, which comprises a substantially unhardened gelatin hydrophilic binder layer coated as an outermost protective layer including at least a dispersed nondiffusing hydroquinone.

9. The photographic element as claimed in claim 2, wherein the silver of said light-sensitive silver halide emulsion is coated at a coverage lower than 0.6 grams per square meter.

10. The photographic element as claimed in claim 2, wherein the gelatin of said light-sensitive silver halide emulsion layer is coated at a silver-gelatin ratio lower than 0.4.

11. The photographic element of claim 2, wherein the tanning developer is hydroquinone.

12. The photographic element of claim 2, wherein the light-sensitive silver halide emulsion is associated with a 3-pyrazolidone compound.

* * * * *